US011222761B2

(12) United States Patent
Yamagata

(10) Patent No.: US 11,222,761 B2
(45) Date of Patent: Jan. 11, 2022

(54) ELECTROMAGNETIC RELAY

(71) Applicant: Panasonic Intellectual Property Management Co., Ltd., Osaka (JP)

(72) Inventor: Katsutoshi Yamagata, Hokkaido (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/957,322

(22) PCT Filed: Dec. 20, 2018

(86) PCT No.: PCT/JP2018/046978
§ 371 (c)(1),
(2) Date: Jun. 23, 2020

(87) PCT Pub. No.: WO2019/131432
PCT Pub. Date: Jul. 4, 2019

(65) Prior Publication Data

US 2020/0350133 A1 Nov. 5, 2020

(30) Foreign Application Priority Data

Dec. 28, 2017 (JP) ..... JP2017-254682

(51) Int. Cl.
*H01H 50/18* (2006.01)
*H01H 50/54* (2006.01)
(Continued)

(52) U.S. Cl.
CPC ..... *H01H 50/18* (2013.01); *H01H 47/22* (2013.01); *H01H 50/02* (2013.01); *H01H 50/44* (2013.01); *H01H 50/54* (2013.01); *H01H 50/58* (2013.01)

(58) Field of Classification Search
CPC ..... H01H 50/18; H01H 50/58; H01H 50/54
(Continued)

(56) References Cited

U.S. PATENT DOCUMENTS 6,075,429 A * 6/2000 Uotome ..... H01H 9/443 335/129
6,781,490 B2 * 8/2004 Funayama ..... H01H 50/026 335/78

(Continued)

FOREIGN PATENT DOCUMENTS

| | | |
|---|---|---|
| JP | 2009-224154 | 10/2009 |
| JP | 2015-133191 | 7/2015 |
| JP | 2016-201187 | 12/2016 |

OTHER PUBLICATIONS

Extended European Search Report, dated Feb. 3, 2021 by the European Patent Office (EPO), in the corresponding European Patent Application No. 18896391.2.

(Continued)

*Primary Examiner* — Alexander Talpalatski
(74) *Attorney, Agent, or Firm* — Greenblum & Bernstein, P.L.C.

(57) ABSTRACT

A displaceable portion of a moving contactor is connected to, and electrically conductive with, a pair of moving contacts. An armature actuates the moving contactor. The armature has an adhering portion to be adhered onto an electromagnet. A space inside an opening that exposes a part (an exposed part) of the displaceable portion crosses a predetermined plane. The predetermined plane intersects at right angles with an arrangement direction (a first direction) in which the pair of moving contacts is arranged side by side. The predetermined plane passes through a center between both ends in the arrangement direction of the adhering portion.

16 Claims, 9 Drawing Sheets

(51) Int. Cl.

| | |
|---|---|
| ***H01H 47/22*** | (2006.01) |
| ***H01H 50/02*** | (2006.01) |
| ***H01H 50/44*** | (2006.01) |
| ***H01H 50/58*** | (2006.01) |

(58) Field of Classification Search
USPC ..... 335/185, 78
See application file for complete search history.

(56) References Cited

U.S. PATENT DOCUMENTS

| | | | | |
|---|---|---|---|---|
| 9,007,156 | B2 * | 4/2015 | Hiraiwa | H01H 9/443 335/78 |
| 9,570,259 | B2 * | 2/2017 | Hasegawa | H01H 51/2272 |
| 2002/0135446 | A1 | 9/2002 | Takano et al. | |
| 2015/0279600 | A1 * | 10/2015 | Hiraiwa | H01H 50/546 335/189 |
| 2016/0300679 | A1 | 10/2016 | Yamagata et al. | |

OTHER PUBLICATIONS

Official Communication issued in International Patent Application No. PCT/JP2018/046978, dated Mar. 12, 2019, along with an English translation thereof.

* cited by examiner

ELECTROMAGNETIC RELAY

TECHNICAL FIELD

The present disclosure generally relates to an electromagnetic relay, and more particularly relates to an electromagnetic relay with a pair of fixed contacts and a pair of moving contacts.

BACKGROUND ART

A known electromagnetic relay is disclosed in, for example, Patent Literature 1. The electromagnetic relay of Patent Literature 1 includes: an excitation coil; a bobbin around which the excitation coil is wound; an iron core inserted into the bobbin; a pair of fixed contacts; a movable spring; and an armature attached to the movable spring. The movable spring includes a moving unit. The moving unit includes a pair of moving contacts. Before the excitation coil is energized, the armature is out of contact with the iron core and the pair of moving contacts is also out of contact with the pair of fixed contacts. Thereafter, when the excitation coil is energized, the iron core is magnetized to attract the armature toward itself, thus displacing the tip of the moving unit of the movable spring with the armature. Subsequently, the pair of moving contacts comes into contact with the pair of fixed contact, respectively.

In the electromagnetic relay of Patent Literature 1, a time lag could be caused between a timing when one moving contact comes into contact with one fixed contact and a timing when the other moving contact comes into contact with the other fixed contact.

CITATION LIST

Patent Literature

Patent Literature 1: JP 2016-201187 A

SUMMARY OF INVENTION

To overcome the problem, an electromagnetic relay according to an aspect of the present disclosure includes a pair of fixed contacts, a moving contactor, an overlay, an electromagnet, and an armature. The moving contactor includes a pair of moving contacts and a displaceable portion. The pair of moving contacts corresponds one to one to the pair of fixed contacts. The displaceable portion is connected to, and electrically conductive with, the pair of moving contacts and displaceable along with the pair of moving contacts. The overlay is arranged to overlap with the displaceable portion. The electromagnet has an excitation coil. The armature actuates the moving contactor by being attracted toward the electromagnet with electromagnetic force generated by the electromagnet to bring each of the pair of moving contacts into, or out of, contact with a corresponding one of the pair of fixed contacts. The armature has an adhering portion. The adhering portion is adhered onto the electromagnet with the electromagnetic force generated by the electromagnet. The overlay has an opening. The opening exposes a part of the displaceable portion. A space inside the opening crosses a predetermined plane. The predetermined plane intersects at right angles with an arrangement direction in which the pair of moving contacts is arranged side by side. The predetermined plane passes through a center between both ends in the arrangement direction of the adhering portion.

DESCRIPTION OF EMBODIMENTS

Embodiments of an electromagnetic relay will be described with reference to the accompanying drawings. Note that the embodiments to be described below are only examples of the present disclosure and should not be construed as limiting. Rather, those embodiments may be readily modified in various manners depending on a design choice or any other factor without departing from a true spirit and scope of the present disclosure.

First Embodiment (Configuration)

Figure 1:
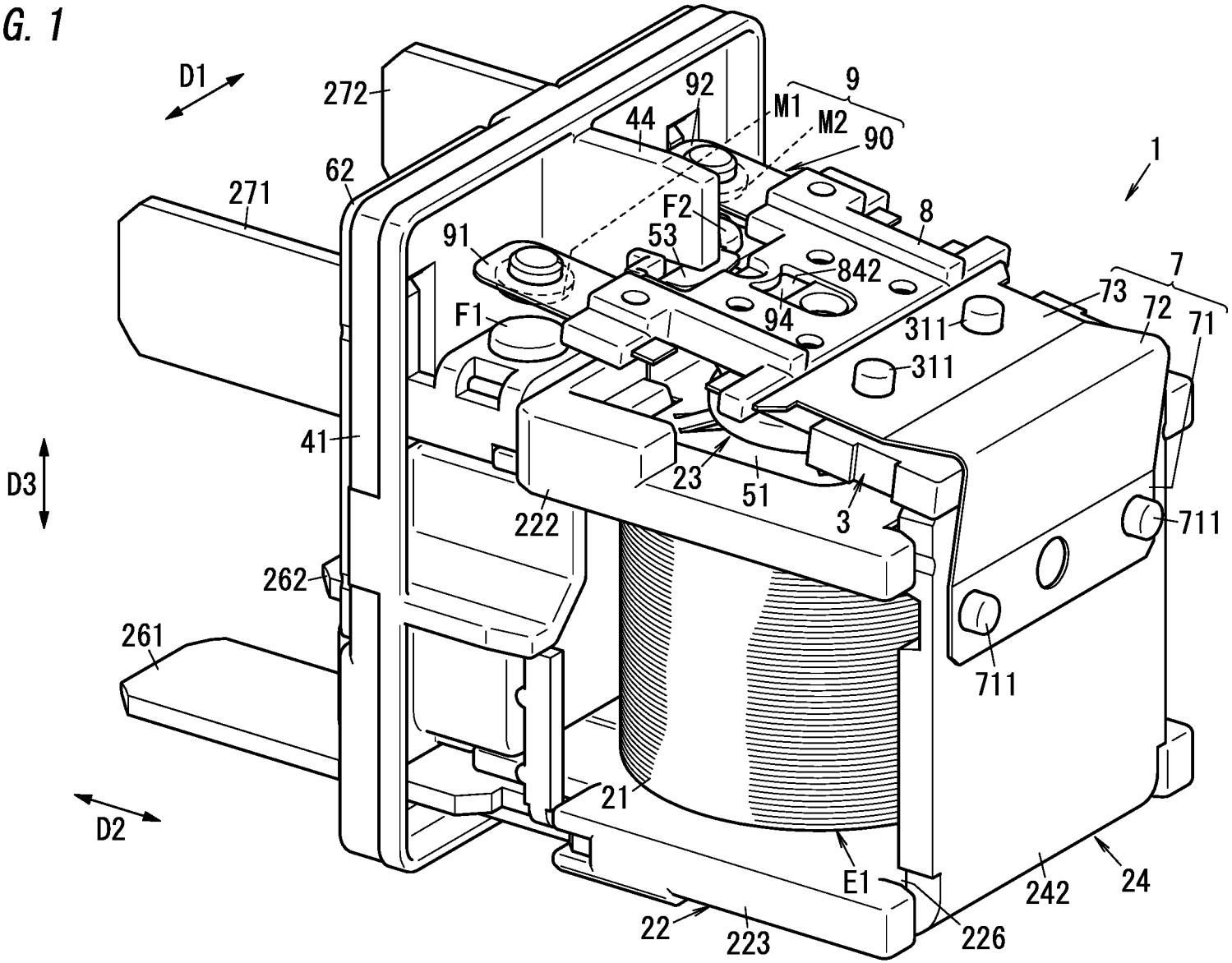
FIG. 1 is a perspective view illustrating an electromagnetic relay according to a first embodiment with its cover removed.
Figure 2:
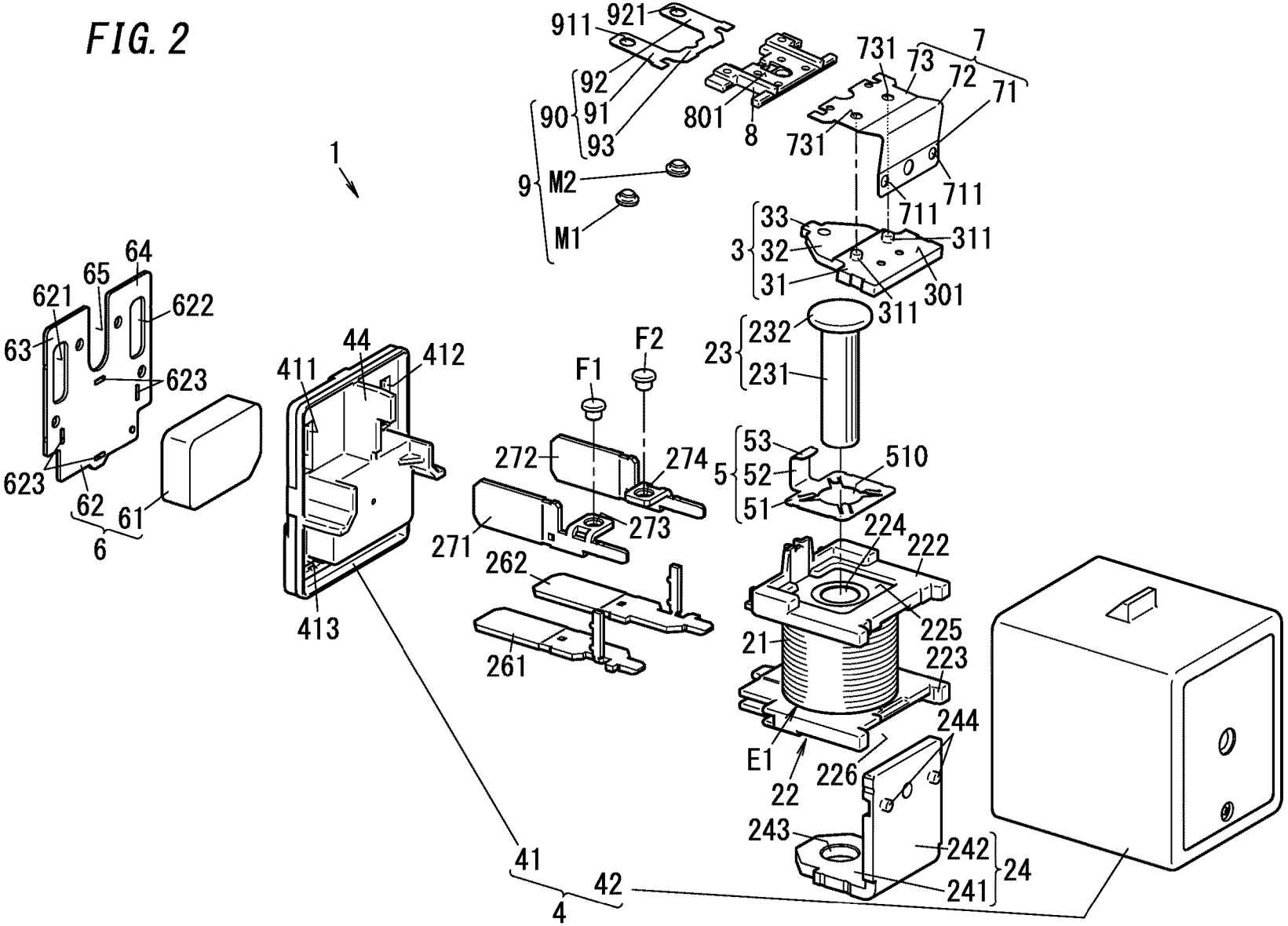
FIG. 2 is an exploded perspective view of the electromagnetic relay.

As shown in FIGS. 1 and 2, an electromagnetic relay 1 includes an electromagnet E1, an armature 3, an overlay 8, a moving contactor 9, and a pair of fixed contacts F1, F2. The electromagnetic relay 1 further includes a movable spring 7.

The electromagnetic relay 1 according to this embodiment is a so-called "hinged relay." The electromagnetic relay 1 may be used, for example, as a device for selectively supplying DC power from a power supply such as a battery for an automobile to a load (such as electric equipment) or cutting off the supply of the DC power. The electromagnetic relay 1 is able to selectively supply DC power from the power supply to the load, or cut off the DC power, by actuating the pair of moving contacts M1, M2 of the moving contactor 9.

Specifically, the armature 3 is connected to the movable spring 7, the movable spring 7 is connected to the overlay 8, and the overlay 8 is connected to the moving contactor 9. When the electromagnet E1 is excited, the armature 3 is attracted toward the electromagnet E1 with the electromagnetic force generated by the electromagnet E1, thereby displacing the armature 3, a base portion 73 of the movable spring 7, the overlay 8, and the moving contactor 9 along with each other. This allows the moving contactor 9 to be actuated such that the moving contact M1 thereof comes into contact with the fixed contact F1 and the moving contact M2 thereof comes into contact with the fixed contact F2. On the other hand, when the electromagnet E1 is demagnetized, the elastic force applied by a bending portion 72 of the movable spring 7 causes the armature 3, the base portion 73 of the movable spring 7, the overlay 8, and the moving contactor 9 to be displaced together such that the armature 3, the base portion 73 of the movable spring 7, the overlay 8, and the moving contactor 9 return to their respective positions before the electromagnet E1 is excited. This allows the moving contactor 9 to be actuated such that the moving contact M1 thereof goes out of contact with the fixed contact F1 and the moving contact M2 thereof goes out of contact with the fixed contact F2.

In the following description, a first direction D1, a second direction D2, and a third direction D3 are defined as follows. As used herein, the first direction D1 (arrangement direction) refers to a direction in which the pair of moving contacts M1, M2 is arranged side by side. The third direction D3 is perpendicular to the first direction D1 and aligned with the direction in which the armature 3 is attracted and displaced toward the electromagnet E1. The second direction D2 is perpendicular to both the first direction D1 and the third direction D3.

The movable spring 7 includes a fixing portion 71, a bending portion 72, and a base portion 73. The fixing portion 71, the bending portion 72, and the base portion 73 may be formed integrally out of a metal such as copper. The movable spring 7 is configured as a leaf spring. The movable spring 7 may be formed in the shape of a generally L-plate. More specifically, the bending portion 72 is formed in the shape of a generally L-plate, and the fixing portion 71 in a plate shape and the base portion 73 in a plate shape are connected to both ends of the bending portion 72.

Figure 3:
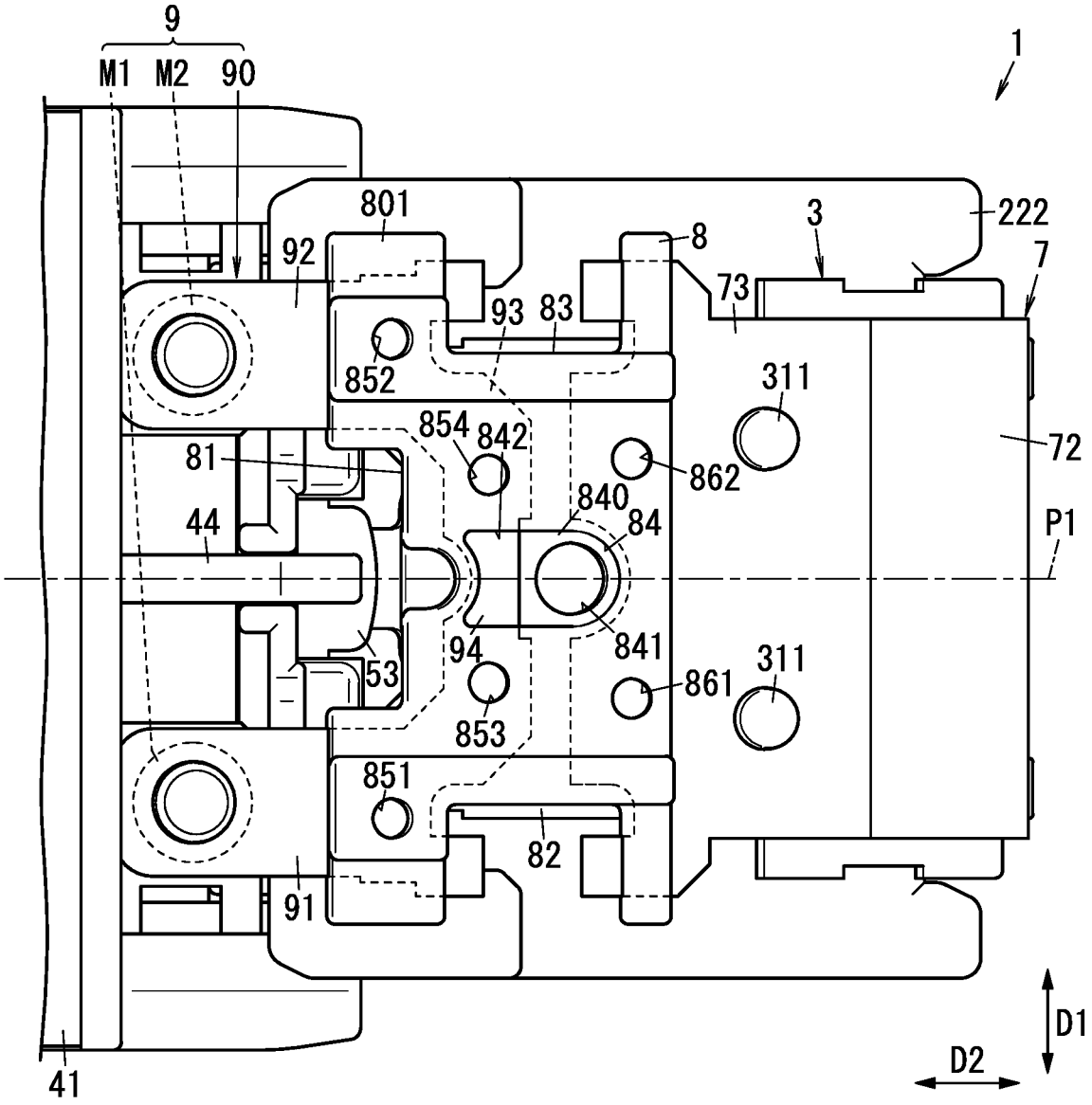
FIG. 3 is a plan view illustrating the electromagnetic relay with its cover removed.

As shown in FIGS. 2 and 3, the moving contactor 9 includes a pair of moving contacts M1, M2 and a displaceable portion 90. The displaceable portion 90 has electrical conductivity. The displaceable portion 90 includes a pair of displaceable springs 91, 92 and a joint portion 93. The pair of displaceable springs 91, 92 and the joint portion 93 may be formed integrally out of an electrically conductive material such as copper.

The displaceable portion 90 is displaced along with the pair of moving contacts M1, M2, which is connected to, and electrically conductive with, the displaceable portion 90. The displaceable portion 90 is formed in the shape of a generally U-flat plate in a plan view. The pair of displaceable springs 91, 92 is each formed in a rectangular shape. The joint portion 93 is formed in a band shape. One longitudinal end of the joint portion 93 is connected to the displaceable spring 91 and the other longitudinal end of the joint portion 93 is connected to the displaceable spring 92. The length of the joint portion 93 is aligned with the first direction D1. Meanwhile, the length of the pair of displaceable springs 91, 92 is aligned with the second direction D2 that is perpendicular to the first direction D1.

The pair of displaceable springs 91, 92 is each implemented as a leaf spring. The displaceable spring 91 is provided for the moving contact M1, while the displaceable spring 92 is provided for the moving contact M2. The displaceable spring 91 is connected to, and electrically conductive with, the moving contact M1. The displaceable spring 92 is connected to, and electrically conductive with, the moving contact M2. More specifically, part of the moving contact M1 is inserted into, and caulked onto, an insert hole 911 cut through the displaceable spring 91. Likewise, part of the moving contact M2 is inserted into, and caulked onto, an insert hole 921 cut through the displaceable spring 92. This allows the moving contact M1 to be fixed onto the displaceable spring 91 and the moving contact M2 to be fixed onto the displaceable spring 92.

As shown in FIG. 3, a first end in the second direction D2 of the overlay 8 is connected to the movable spring 7, and a second end in the second direction D2 of the overlay 8 is connected to the displaceable portion 90. That is to say, the movable spring 7 is connected to the moving contactor 9 via the overlay 8. The overlay 8 may be made of a resin, for example, and has electrical insulation properties. The overlay 8 electrically insulates the movable spring 7 and the moving contactor 9 from each other. The overlay 8 may be formed in a generally rectangular plate shape. The overlay 8 may be formed integrally with the movable spring 7 and the displaceable portion 90, for example. Part of the movable spring 7 and part of the displaceable portion 90 are overlapped by the overlay 8. More specifically, the part of the movable spring 7 and the part of the displaceable portion 90 are embedded in the overlay 8.

The second end in the second direction D2 of the overlay 8 has a recess 81. The pair of displaceable springs 91, 92 of the displaceable portion 90 protrudes from respective portions, adjacent in the first direction D1 to the recess 81, of the overlay 8. In addition, both ends in the first direction D1 of the overlay 8 also each have a recess 82, 83. Part of the movable spring 7 and part of the displaceable portion 90 are exposed through each of these recesses 82, 83.

Figure 4:
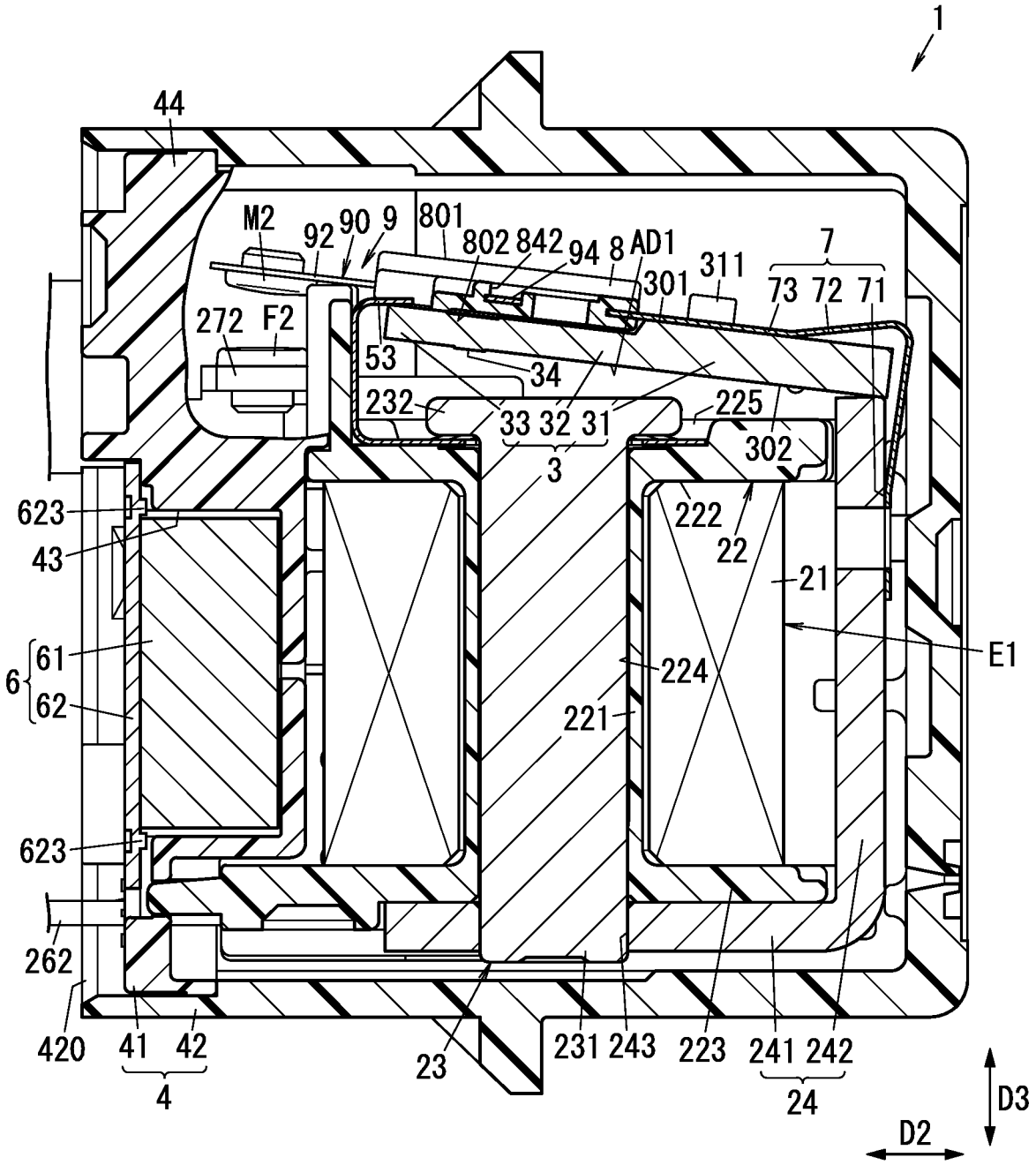
FIG. 4 is a cross-sectional view of the electromagnetic relay taken along a plane corresponding to the plane P1 shown in FIG. 3.

The overlay 8 has a first surface 801 and a second surface 802 (see FIG. 4) facing the pair of fixed contacts F1, F2 (see FIG. 4) and the electromagnet E1 (see FIG. 4). The first surface 801 is opposite from the second surface 802. The first surface 801 has a depression 84. The overlay 8 is depressed, at the depression 84, in the third direction D3 (see FIG. 4). That is to say, the overlay 8 is depressed, at the depression 84, along the thickness of the overlay 8.

The depression 84 has a through hole 841. The through hole 841 is cut open through the bottom 840 of the depression 84 and runs through the thickness of the overlay 8. The through hole 841 has a circular shape.

The bottom 840 also has an opening (window) 842. That is to say, the overlay 8 is further depressed, at the opening 842, from the bottom 840. Part of the joint portion 93 of the displaceable portion 90 is exposed (as an exposed part 94) through the opening 842 to the outside of the overlay 8. The exposed part 94 includes a part, located at an equal distance in the first direction D1 from both ends of the joint portion 93, of the joint portion 93. The opening 842 is provided in a region, located at an equal distance in the first direction D1 from both ends of the overlay 8, of the overlay 8. As used herein, "equal" is not applied to only a situation where the two distances are exactly equal to each other. Rather, the two distances are herein regarded as "equal to each other" as long as the difference between the two distances falls within a tolerance range (e.g., if the shorter distance is 90% or more of the longer distance).

In the overlay 8, the opening 842 is located opposite from the second surface 802 (see FIG. 4). In other words, in the direction in which the displaceable portion 90 and the electromagnet E1 (see FIG. 4) are arranged one on top of the other (i.e., in the direction aligned with the third direction D3), the opening 842 is located on the opposite side from the electromagnet E1 with respect to the displaceable portion 90 (see FIG. 4). Alternatively, the space inside the opening 842 may run through the overlay 8 to reach the second surface 802 of the overlay 8.

In addition, the overlay 8 further has four circular depressions 851, 852, 853, 854 and two circular through holes 861, 862, all of which are cut through the first surface 801. Through the depression 851, part of the displaceable spring 91 of the displaceable portion 90 is exposed to the outside of the overlay 8. Through the depression 852, part of the displaceable spring 92 is exposed to the outside of the overlay 8. Through each of the depressions 853, 854, part of the joint portion 93 is exposed to the outside of the overlay 8. Through each of the through holes 861, 862, part of the base portion 73 of the movable spring 7 is exposed to the outside of the overlay 8.

The base portion 73 of the movable spring 7 is partially covered with the overlay 8. The joint portion 93 is entirely covered with the overlay 8 but the parts exposed through the depressions 853, 854 to the outside of the overlay 8 and the exposed part 94. Each of the two displaceable springs 91, 92 is partially covered with the overlay 8.

As shown in FIGS. 2 and 4, the electromagnet E1 includes an excitation coil 21, an iron core 23, and a first yoke 24. The electromagnetic relay 1 further includes a bobbin 22, a pair of coil terminals 261, 262, a pair of primary terminals 271, 272, a case 4, a stopper block 5, and an arc extinction mechanism 6.

The bobbin 22 includes a cylindrical portion 221 and a pair of rims 222, 223. The cylindrical portion 221 is formed in the shape of a circular cylinder. Each of the pair of rims 222, 223 is formed in the shape of a generally square frame. The pair of rims 222, 223 is connected to both axial ends of the cylindrical portion 221. The bobbin 22 has an insert hole 224 running along the axis of the cylindrical portion 221 and inside the cylindrical portion 221 and the pair of rims 222, 223. The cylindrical portion 221 and the pair of rims 222, 223 have electrical insulation properties. The excitation coil 21 is wound around the cylindrical portion 221. The axis of the excitation coil 21 and the cylindrical portion 221 is aligned with the third direction D3. The distance from the rim 222 to the moving contactor 9 is shorter than the distance from the rim 223 to the moving contactor 9. A region surrounding the insert hole 224 of the rim 222 has a recess 225.

The iron core 23 includes a shaft 231 and a head 232. The shaft 231 is formed in a columnar shape and more specifically formed in the shape of a circular column. The axis of the shaft 231 is aligned with the third direction D3. The shaft 231 is passed through the insert hole 224 of the bobbin 22. The head 232 is formed in a disk shape. The head 232 is connected to one end of the shaft 231. The shaft 231 and the head 232 are formed integrally out of a magnetic material.

The first yoke 24 includes a first piece 241 and a second piece 242 and is formed in the shape of a generally L-plate. The second piece 242 is extended from one end of the first piece 241 along the thickness of the first piece 241. The first piece 241 and the second piece 242 are formed integrally out of a magnetic material. The second piece 242 is fitted into a recess 226 of the rim 223 of the bobbin 22. The second piece 242 is arranged along the axis of the cylindrical portion 221 of the bobbin 22. The first piece 241 has an insert hole 243. Into the insert hole 243, a portion, opposite from the head 232, of the shaft 231 of the iron core 23 is passed. The first yoke 24 and the iron core 23 together form a magnetic path, through which a magnetic flux produced when the excitation coil 21 is energized passes.

The fixing portion 71 of the movable spring 7 is fixed onto the second piece 242 of the first yoke 24, thus fixing the movable spring 7 onto the first yoke 24. More specifically, two projections 244 on the second piece 242 are inserted into two insert holes 711 cut through the fixing portion 71 and have their respective tips crushed, thereby fixing the movable spring 7 onto the first yoke 24. That is to say, the movable spring 7 is fixed by caulking onto the first yoke 24.

The armature 3 is formed in the shape of a plate. The armature 3 includes a base end portion 31, an extended portion 32, and a protruding portion 33. The base end portion 31, the extended portion 32, and the protruding portion 33 are formed integrally out of a magnetic material. The base end portion 31 is formed in a rectangular shape. The extended portion 32 is extended from one side of the base end portion 31 generally parallel to the base end portion 31. The extended portion 32 is formed in the shape of a trapezoid, of which the width measured in the first direction D1 (see FIG. 6) decreases as the distance from the base end portion 31 increases. The protruding portion 33 protrudes from the other end, opposite from the base end portion 31, of the extended portion 32.

The armature 3 is fixed onto the base portion 73 of the movable spring 7. More specifically, two projections 311 on the base end portion 31 of the armature 3 are inserted into two insert holes 731 cut through the base portion 73 and have their respective tips crushed, thereby fixing the armature 3 onto the base portion 73. That is to say, the armature 3 is fixed by caulking onto the base portion 73. The armature 3 is displaced along with the base portion 73, the overlay 8, and the moving contactor 9. The direction in which the armature 3, the base portion 73, the overlay 8, the displaceable portion 90 of the moving contactor 9, and the pair of moving contacts M1, M2 are displaced is aligned with the third direction D3. One end, located closer to the fixing portion 71, of the armature 3 is in contact with the second piece 242 of the first yoke 24. The armature 3 is supported by the second piece 242.

A first surface 301, facing the movable spring 7, of the armature 3 is depressed in the extended portion 32 with respect to the base end portion 31. A second surface 302, opposite from the first surface 301, of the armature 3 is formed as a flat surface. The armature 3 further includes a raised portion 34 (see FIG. 4), which is slightly raised from the second surface 302.

When the excitation coil 21 is not energized, the second surface 302 of the armature 3 faces the head 232 of the iron core 23. When the excitation coil 21 is energized, the second surface 302 of the armature 3 is adhered onto the head 232 with the electromagnetic force generated by the electromagnet E1.

Each of the pair of coil terminals 261, 262 is made of an electrically conductive material such as copper. Each of the pair of coil terminals 261, 262 has electrical conductivity. Each of the pair of coil terminals 261, 262 is formed in the shape of an elongated plate. A first terminal portion of the excitation coil 21 is wound around, and connected by soldering to, the coil terminal 261. A second terminal portion of the excitation coil 21 is wound around, and connected by soldering to, the coil terminal 262. The excitation coil 21 is supplied with an electric current through the pair of coil terminals 261, 262, thereby generating a magnetic flux.

Each of the pair of primary terminals 271, 272 is made of an electrically conductive material such as copper, formed in the shape of an elongated plate, and has electrical conductivity. The fixed contact F1 is fixed onto the primary terminal 271, and the fixed contact F2 is fixed onto the primary terminal 272. More specifically, part of the fixed contact F1 is inserted into, and caulked onto, an insert hole 273 cut through the primary terminal 271, and part of the fixed contact F2 is inserted into, and caulked onto, an insert hole 274 cut through the primary terminal 272. This allows the fixed contact F1 to be electrically connected and fixed to the primary terminal 271 and also allows the fixed contact F2 to be electrically connected and fixed to the primary terminal 272.

The pair of fixed contacts F1, F2 is arranged side by side in the first direction D1 (see FIG. 1). The moving contact M1 corresponds to the fixed contact F1 and the moving contact M2 corresponds to the fixed contact F2. The moving contact M1 is provided at a position in the third direction D3 where the moving contact M1 faces the fixed contact F1. The moving contact M2 is provided at a position in the third direction D3 where the moving contact M2 faces the fixed contact F2. The moving contact M1 comes into, and goes out of, contact with the fixed contact F1. The moving contact M2 comes into, and goes out of, contact with the fixed contact F2.

Figure 5:
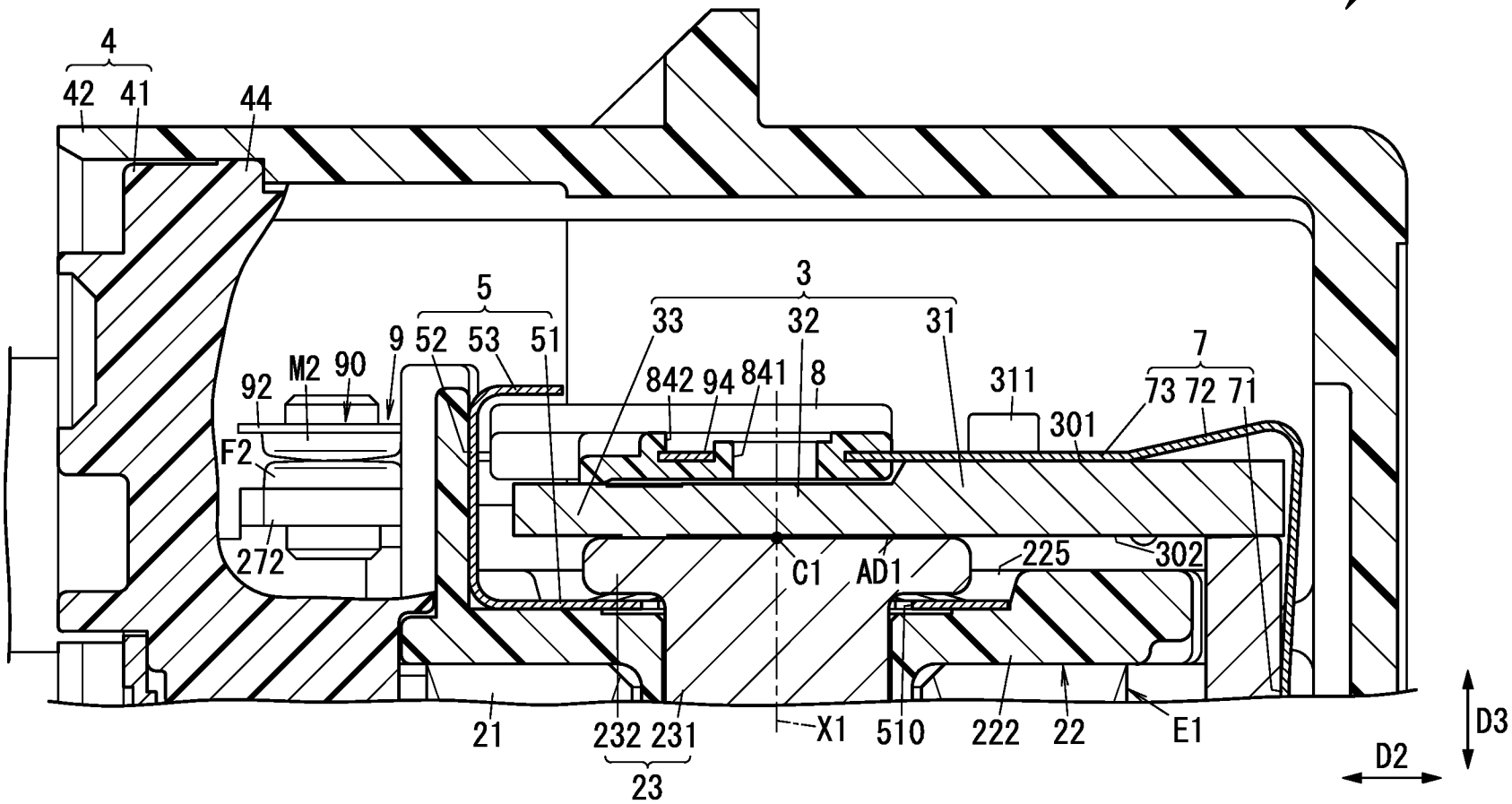
FIG. 5 is a cross-sectional view illustrating a main part of the electromagnetic relay in a closed-circuit state thereof.

While the excitation coil 21 is not energized, the moving contact M2 is out of contact, and electrically nonconductive, with the fixed contact F2 as shown in FIGS. 1 and 4. At this time, the moving contact M1 is also out of contact, and electrically nonconductive, with the fixed contact F1. When the excitation coil 21 is energized, the armature 3 is attracted toward the head 232 of the iron core 23 with the electromagnetic force generated by the electromagnet E1, thus displacing the armature 3 along with the base portion 73, the overlay 8, and the moving contactor 9. As a result, the moving contact M2 comes into contact, and becomes electrically conductive, with the fixed contact F2 as shown in FIG. 5. In addition, the moving contact M1 (see FIG. 1) also comes into contact, and becomes electrically conductive, with the fixed contact F1 (see FIG. 1). Meanwhile, the armature 3 is adhered onto the head 232 of the iron core 23.

The pair of moving contacts M1, M2 is electrically connected together via the displaceable portion 90. The pair of primary terminals 271, 272 (see FIG. 1) is electrically connected between the power supply and the load. While the moving contact M2 and the fixed contact F2 and/or the moving contact M1 and the fixed contact F1 are electrically nonconductive, the pair of primary terminals 271, 272 becomes electrically isolated, and therefore, no DC power is supplied from the power supply to the load. When the moving contact M2 comes into contact, and becomes electrically conductive, with the fixed contact F2 and the moving contact M1 comes into contact, and becomes electrically conductive, with the fixed contact F1, the pair of primary terminals 271, 272 becomes electrically conductive and DC power is supplied from the power supply to the load.

As shown in FIG. 2, the case 4 includes a generally square base 41 and a box-shaped cover 42. The base 41 and the cover 42 may be made of a resin, for example, and have electrical insulation properties. One surface of the cover 42 has an opening 420 (see FIG. 4). The base 41 is attached to the cover 42 so as to be inserted into the opening 420. The case 4 houses the electromagnet E1, the bobbin 22, the armature 3, the stopper block 5, the movable spring 7, the overlay 8, the moving contactor 9, and the pair of fixed contacts F1, F2.

The base 41 has an insert hole 411 to pass the primary terminal 271 therethrough, an insert hole 412 to pass the primary terminal 272 therethrough, an insert hole 413 to pass the coil terminal 261 therethrough, and an insert hole to pass the coil terminal 262 therethrough. As shown in FIG. 4, the base 41 has a recess 43, which is open toward the outside of the case 4. More specifically, the recess 43 is provided for a portion, adjacent in the second direction D2 to the excitation coil 21, of the base 41. The electromagnetic relay 1 further includes a wall portion 44 protruding from the base 41. As shown in FIG. 1, the wall portion 44 is provided between the pair of fixed contacts F1, F2 attached to the pair of primary terminals 271, 272 to separate the fixed contacts F1, F2 from each other. In addition, the wall portion 44 is also provided between the pair of moving contacts M1, M2 to separate the moving contacts M1, M2 from each other.

As shown in FIGS. 2 and 5, the stopper block 5 includes a base portion 51, an extended portion 52, and a stopper 53. The base portion 51, the extended portion 52, and the stopper 53 may be made of a non-magnetic metal such as copper. The stopper 53 regulates the displacement of the armature 3.

The base portion 51 is formed in a plate shape. The base portion 51 is fixed onto the bobbin 22. The base portion 51 has a through hole 510, through which the shaft 231 of the iron core 23 is passed. In a state where the base portion 51 is fitted into the recess 225 of the rim 222 of the bobbin 22 and the shaft 231 of the iron core 23 is passed through the through hole 510, the base portion 51 is fixed to be sandwiched between the head 232 of the iron core 23 and the bobbin 22.

The extended portion 52 is formed in a plate shape. The extended portion 52 is extended from the base portion 51 along the thickness of the base portion 51.

The stopper 53 is formed in a plate shape. The stopper 53 protrudes from the tip of the extended portion 52 along the thickness of the extended portion 52. That is to say, the stopper 53 is provided to be generally parallel to the base portion 51. The stopper 53 has elasticity. Part of the wall portion 44 is adjacent to the stopper 53 on the opposite side from the armature 3 with respect to the stopper 53.

As shown in FIGS. 2 and 4, the arc extinction mechanism 6 includes a permanent magnet 61 and a second yoke 62.

When the moving contact M1 goes out of contact with the fixed contact F1 and the moving contact M2 goes out of contact with the fixed contact F2 with the supply of electric current to the excitation coil 21 cut off, an arc may be generated between the moving contact M1 and the fixed contact F1 and between the moving contact M2 and the fixed contact F2. The arc generated between the moving contact M1 and the fixed contact F1 and the arc generated between the moving contact M2 and the fixed contact F2 may be stretched out of the electromagnetic relay 1 by the permanent magnet 61 and the second yoke 62.

The permanent magnet 61 is formed in the shape of a rectangular parallelepiped. The permanent magnet 61 is housed in the recess 43 of the base 41. The permanent magnet 61 is also adjacent in the third direction D3 to the pair of fixed contacts F1, F2. Also, the permanent magnet 61 is arranged, in the second direction D2, between the excitation coil 21 and the second yoke 62. The permanent magnet 61 may be configured as, for example, a ferrite magnet. The permanent magnet 61 may be arranged such that its portion facing the second yoke 62 is N pole and its portion facing the excitation coil 21 is S pole.

The second yoke 62 is formed in the shape of a generally square plate. The second yoke 62 may be made of an iron-based magnetic material (such as a galvanized steel plate). The second yoke 62 is adhered to the permanent magnet 61 with magnetic force. The second yoke 62 has an insert hole 621 through which the primary terminal 271 is passed and an insert hole 622 through which the primary terminal 272 is passed.

The second yoke 62 further includes: an adjacent portion 63 to be adjacent in the second direction D2 to the fixed contact F1 and the moving contact M1; and an adjacent portion 64 to be adjacent in the second direction D2 to the fixed contact F2 and the moving contact M2. The pair of adjacent portions 63, 64 is connected together and has a cutout 65 between them.

The second yoke 62 further has a plurality of (e.g., four in the example illustrated in FIG. 2) projections 623 protruding from the pair of adjacent portions 63, 64. The permanent magnet 61 is positioned between the plurality of projections 623.

Figure 6:
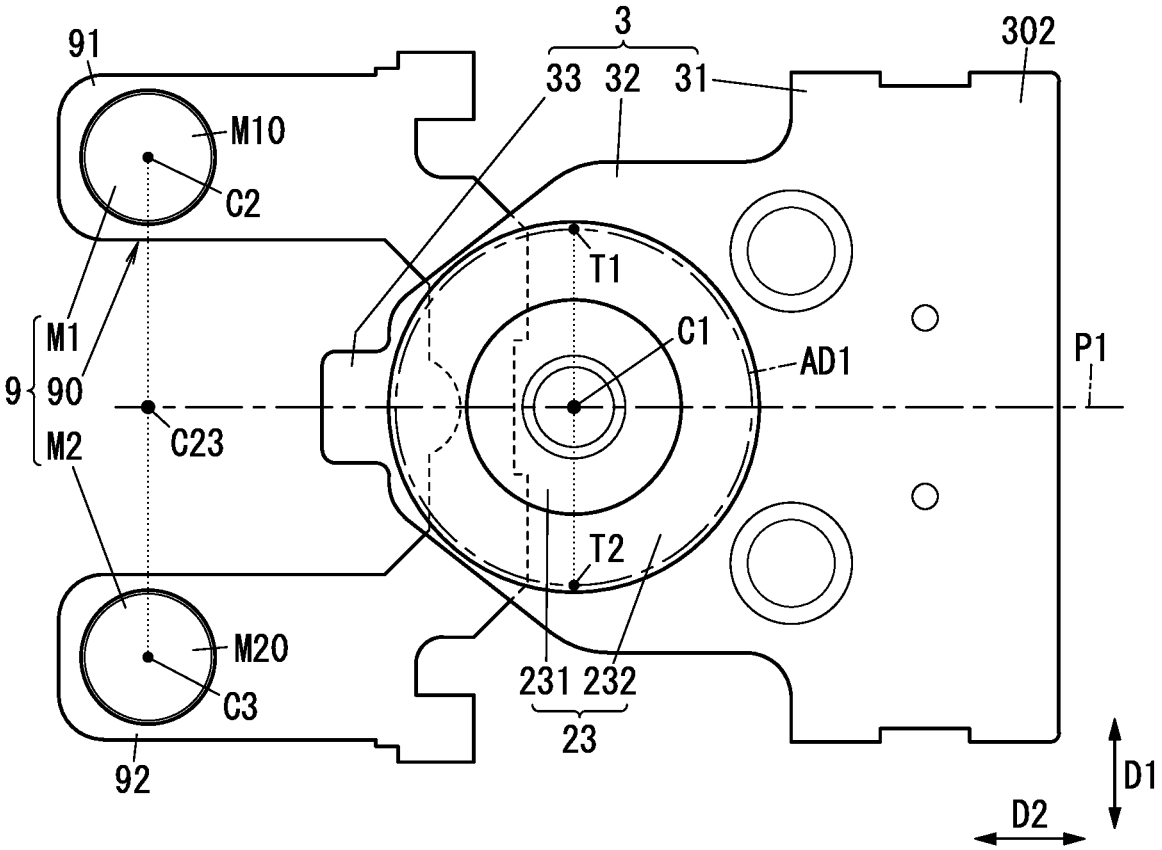
FIG. 6 is a bottom view illustrating an armature, an iron core, and a moving contactor of the electromagnetic relay.

FIG. 6 illustrates, among various constituent elements of the electromagnetic relay 1, only the armature 3, the iron core 23, and the moving contactor 9 to show a state where the armature 3 is adhered onto the iron core 23. As shown in FIGS. 5 and 6, the armature 3 includes an adhering portion AD1 to be adhered onto the head 232 of the iron core 23 of the electromagnet E1. The adhering portion AD1 is a circular portion of the armature 3 to overlap, in the third direction D3, with the head 232 when adhered onto the head 232. Note that the region occupied by the adhering portion AD1 in FIG. 6 is a virtual region. The adhering portion AD1 is located in the extended portion 32 of the armature 3. The adhering portion AD1 faces the head 232. Both ends (ends T1, T2) in the first direction D1 (arrangement direction) of the adhering portion AD1 are arranged in the first direction D1. Note that both of these ends T1 and T2 are virtual points. These ends T1 and T2 are two outermost points in the first direction D1 of the adhering portion AD1, which are located on mutually opposite sides (i.e., on the upper and lower sides on the paper on which FIG. 6 is drawn) in the first direction D1 of the adhering portion AD1.

While the armature 3 is adhered onto the head 232, the peripheral edge of the head 232 and the peripheral edge of the adhering portion AD1 overlap with each other in the third direction D3. Also, at this time, the center C1 between the ends T1 and T2 is aligned in the third direction D3 with the center of the head 232. Furthermore, at this time, the center C1 is located on the extension of the center axis X1 of the shaft 231 of the iron core 23. Furthermore, at this time, the through hole 841 of the overlay 8 is also located on the extension of the center axis X1 of the shaft 231. Furthermore, at this time, the exposed part 94 overlaps in the third direction D3 with the iron core 23 with the overlay 8 and the armature 3 interposed between exposed part 94 itself and the iron core 23. More specifically, the exposed part 94 overlaps in the third direction D3 with the shaft 231 of the iron core 23 with the overlay 8 and the armature 3 interposed between exposed part 94 itself and the iron core 23.

As shown in FIGS. 3 to 6, the plane P1 (predetermined plane) intersecting at right angles with the first direction D1 (arrangement direction) and passing through the center C1 crosses the space inside the opening 842. In addition, the plane P1 also crosses the exposed part 94. Moreover, the plane P1 also crosses the space inside the through hole 841. Furthermore, the plane P1 further crosses the stopper 53. The plane P1 is aligned with the second direction D2 and the third direction D3. The iron core 23, the armature 3, the movable spring 7, the overlay 8, and the moving contactor 9 each have a shape symmetric with respect to the plane P1.

The midpoint C23 between the respective centers C2 and C3 of the pair of moving contacts M1, M2 is located on the plane P1. The center C2 is the center of the surface M10 of the moving contact M1 when the moving contact M1 is viewed from the fixed contact F1. The center C3 is the center of the surface M20 of the moving contact M2 when the moving contact M2 is viewed from the fixed contact F2.

If the exposed part 94 and the center C1 of the adhering portion AD1 are projected in the third direction D3, then the exposed part 94 and the center C1 are located side by side in the second direction D2 (see FIGS. 3 and 6). In short, when viewed in the third direction D3, the exposed part 94 and the center C1 overlap with the plane P1.

(Operation)

Next, it will be described with reference to FIGS. 4 and 5 how the electromagnetic relay 1 according to this embodiment operates.

First of all, when the excitation coil 21 is not energized, the elastic action of the movable spring 7 fixed to the armature 3 keeps the armature 3 out of contact with the iron core 23 and in contact with the stopper 53 as shown in FIG. 4. Specifically, the stopper 53 is in contact with the armature 3 on the opposite side from the electromagnet E1 in the direction in which the adhering portion AD1 (see FIG. 5) and the electromagnet E1 are arranged one on top of the other (i.e., in the direction aligned with the third direction D3). More specifically, the stopper 53 is in contact with the armature 3 at the tip thereof that is the end opposite from the end, closer to the extended portion 52, of the stopper 53 (i.e., the base end of the stopper 53). At this time, the moving contact M2 is out of contact with the fixed contact F2 and the moving contact M1 (see FIG. 1) is out of contact with the fixed contact F1 (see FIG. 1).

When the excitation coil 21 is energized, the iron core 23 is magnetized and the electromagnetic force generated by the electromagnet E1 causes the armature 3 to be attracted toward the head 232 of the iron core 23, thus bringing the armature 3 out of contact with the stopper 53. That is to say, the armature 3 is displaced toward the iron core 23. Thus, the movable spring 7 is elastically deformed at the bending portion 72 to have its base portion 73 displaced toward the iron core 23. This causes the overlay 8 and the moving contactor 9 to be displaced toward the iron core 23 as well. Thereafter, as shown in FIG. 5, the moving contact M2 comes into contact with the fixed contact F2, the moving contact M1 (see FIG. 1) comes into contact with the fixed contact F1 (see FIG. 1), and the armature 3 is adhered onto the head 232 of the iron core 23. Consequently, the moving contact M2 and the fixed contact F2 become electrically conductive with each other and the moving contact M1 and the fixed contact F1 also become electrically conductive with each other.

That is to say, the armature 3 is attracted toward the electromagnet E1 with the electromagnetic force generated by the electromagnet E1 to actuate the movable spring 7. As the movable spring 7 is actuated, the overlay 8 and the moving contactor 9 are also actuated and displaced. In this manner, the armature 3 actuates the moving contactor 9 indirectly. In the moving contactor 9, the displaceable portion 90 and the pair of moving contacts M1, M2 connected to the displaceable portion 90 are displaced together.

When the supply of electric current to the excitation coil 21 is cut off, the iron core 23 is demagnetized, the movable spring 7 is elastically deformed at the bending portion 72, and the base portion 73 of the movable spring 7 is displaced away from the iron core 23. Accordingly, the armature 3 goes out of contact with the head 232 of the iron core 23 and the overlay 8 and the moving contactor 9 are also displaced away from the iron core 23. Thus, the moving contact M1 goes out of contact with the fixed contact F1 and the moving contact M2 goes out of contact with the fixed contact F2. As a result, the moving contact M1 and the fixed contact F1 are electrically isolated from each other, and the moving contact M2 and the fixed contact F2 are also electrically isolated from each other. Thereafter, the armature 3 comes into contact with the stopper 53. When the armature 3 comes into contact with the stopper 53, the elasticity of the stopper 53 reduces the impact of collision of the armature 3 against the stopper 53.

While the excitation coil 21 is energized and the armature 3 is being attracted toward the head 232 of the iron core 23, there is a gap between the armature 3 and the head 232 the moment when the moving contact M1 comes into contact with the fixed contact F1 and the moment when the moving contact M2 comes into contact with the fixed contact F2. Thereafter, while the pair of displaceable springs 91, 92 (see FIG. 1) is elastically deformed so as to be flexed on the pair of moving contacts M1, M2 as fulcrums, the armature 3 comes even closer toward, and is soon adhered onto, the head 232. Thereafter, when the supply of electric current to the excitation coil 21 is cut off to bring the armature 3 out of contact with the head 232, the pair of displaceable springs 91, 92 recovers their original shape due to their elasticity.

(Method for Detecting Degree of Synchronism Between Respective Pairs of Contacts)

Figure 7:
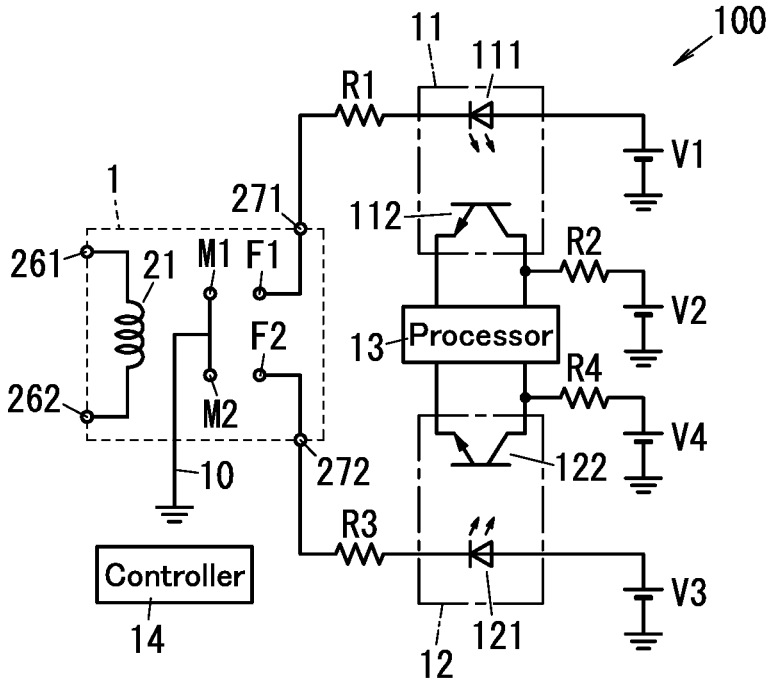
FIG. 7 is a circuit diagram illustrating a circuit that uses the electromagnetic relay.

Next, an exemplary method for detecting the degree of synchronism between the respective pairs of contacts will be described. As used herein, "detecting the degree of synchronism between the respective pairs of contacts" refers to determining whether or not the timing when the moving contact M1 comes into contact with the fixed contact F1 agrees with the timing when the moving contact M2 comes into contact with the fixed contact F2 or how long the time lag is if the answer is NO. Detection of the degree of synchronism between the respective pairs of contacts may be performed during the manufacturing process of the electromagnetic relay 1. In this embodiment, to detect the degree of synchronism between the respective pairs of contacts, not only the electromagnetic relay 1 but also a detector circuit 100, a processor 13 implementable as a programmable logic controller (PLC), for example, and a controller 14 implementable as a PLC, for example, are used as shown in FIG. 7.

The detector circuit 100 includes: four power supply units V1-V4; a probe 10; four resistors R1-R4; and a pair of photocouplers 11, 12.

The primary terminal 271 of the electromagnetic relay 1 is connected to the power supply unit V1 via a series circuit of a light-emitting element 111 (such as a light-emitting diode) of the photocoupler 11 and the resistor R1. A photosensitive element 112 (such as a phototransistor) of the photocoupler 11 is connected to the processor 13. The photosensitive element 112 is connected to the power supply unit V2 via the resistor R2. A voltage is applied from the power supply unit V2 to the processor 13 via the resistor R2.

In the same way, the primary terminal 272 of the electromagnetic relay 1 is connected to the power supply unit V3 via a series circuit of a light-emitting element 121 (such as a light-emitting diode) of the photocoupler 12 and the resistor R3. A photosensitive element 122 (such as a phototransistor) of the photocoupler 12 is connected to the processor 13. The photosensitive element 122 is connected to the power supply unit V4 via the resistor R4. A voltage is applied from the power supply unit V4 to the processor 13 via the resistor R4.

The probe 10 is a member for actuating the moving contactor 9. The probe 10 may be formed in a circular columnar shape, for example. The probe 10 may have a diameter of 0.5 mm, for example. The probe 10 has electrical conductivity. The probe 10 is grounded. Through a computer control performed by the controller 14, the probe 10 is pressed against the exposed part 94 of the moving contactor 9 and displaced toward the iron core 23. Meanwhile, based on information about the specifics of the control performed by the controller 14 on the probe 10, the controller 14 measures the magnitude of displacement of the probe 10 since the probe 10 has been pressed against the exposed part 94 and outputs the magnitude thus measured to the processor 13.

The degree of synchronism between the respective pairs of contacts is detected while no voltage is applied to the pair of coil terminals 261, 262. That is to say, the degree of synchronism between the respective pairs of contacts is detected while no attractive force is produced between the iron core 23 of the electromagnet E1 and the armature 3. Furthermore, the degree of synchronism between the respective pairs of contacts starts to be detected in a state where the moving contact M1 is out of contact with the fixed contact F1 and the moving contact M2 is out of contact with the fixed contact F2. Furthermore, the degree of synchronism between the respective pairs of contacts is detected with the cover 42 removed from the electromagnetic relay 1.

In this state, under the control of the controller 14, the probe 10 is pressed against the exposed part 94 of the moving contactor 9 through the opening 842 of the overlay 8. Thus, the probe 10 is electrically connected to the moving contactor 9.

The probe's 10 pressing, at the exposed part 94, the moving contactor 9 toward the iron core 23 of the electromagnet E1 causes the movable spring 7 to be elastically deformed at the bending portion 72, thus displacing the moving contactor 9, the overlay 8, the base portion 73 of the movable spring 7, and the armature 3 toward the iron core 23. This soon brings the moving contact M1 into contact with the fixed contact F1 and also brings the moving contact M2 into contact with the fixed contact F2. In the following description, it will be described how the probe's 10 further pressing the moving contactor 9 toward the iron core 23 after the moving contact M1 has come into contact with the fixed contact F1 brings the moving contact M2 into contact with the fixed contact F2.

When the moving contact M1 comes into contact with, and becomes electrically conductive with, the fixed contact F1, a circuit section ranging from the power supply unit V1 to the ground node of the probe 10 becomes electrically conductive via the probe 10. Thus, an electric current flows through the light-emitting element 111 of the photocoupler 11, and therefore, an electric current flows between the collector and emitter of the photosensitive element 112 and the voltage applied to the processor 13 decreases to approximately 0 volts. This allows the processor 13 to detect that the moving contact M1 has come into contact with the fixed contact F1.

Likewise, when the moving contact M2 comes into contact with, and becomes electrically conductive with, the fixed contact F2, a circuit section ranging from the power supply unit V3 to the ground node becomes electrically conductive via the probe 10. Thus, an electric current flows through the light-emitting element 121 of the photocoupler 12, and therefore, an electric current flows between the collector and emitter of the photosensitive element 122 and the voltage applied to the processor 13 decreases to approximately 0 volts. This allows the processor 13 to detect that the moving contact M2 has come into contact with the fixed contact F2.

The processor 13 detects, based on the output of the controller 14, the magnitude of displacement of the probe 10 since a point in time when the contact of the moving contact M1 with the fixed contact F1 has been detected through a point in time when the contact of the moving contact M2 with the fixed contact F2 is detected.

Note that even if the moving contact M1 comes into contact with the fixed contact F1 after the moving contact M2 has come into contact with the fixed contact F2, the degree of synchronism between the respective contacts may also be detected in the same way as described above. That is to say, the processor 13 may also detect, based on the output of the controller 14, the magnitude of displacement of the probe 10 since a point in time when the contact of the moving contact M2 with the fixed contact F2 has been detected through a point in time when the contact of the moving contact M1 with the fixed contact F1 is detected.

That is to say, the time lag between the timing when the moving contact M1 comes into contact with the fixed contact F1 and the timing when the moving contact M2 comes into contact with the fixed contact F2 may be detected as the magnitude of displacement of the probe 10 by the detector circuit 100, the processor 13, and the controller 14.

Optionally, the tester may change the distance from the moving contact M1 to the fixed contact F1 and the distance from the moving contact M2 to the fixed contact F2 by bending, according to the detected magnitude of displacement of the probe 10, at least one of the pair of displaceable springs 91, 92. This allows the time lag between the timing when the moving contact M1 comes into contact with the fixed contact F1 and the timing when the moving contact M2 comes into contact with the fixed contact F2 to be adjusted (reduced). This time lag adjustment does not have to be performed manually but may be done by computer control as well.

Meanwhile, if the timing when the moving contact M1 comes into contact with the fixed contact F1 substantially agrees with the timing when the moving contact M2 comes into contact with the fixed contact F2, then the magnitude of displacement of the probe 10 is detected to be approximately zero.

When an electric circuit covering the range from the fixed contact F1 to the fixed contact F2 via the moving contact M1, the displaceable portion 90, and the moving contact M2 is closed, an arc may be generated. If there is a time lag between the timing when moving contact M1 comes into contact with the fixed contact F1 and the timing when the moving contact M2 comes into contact with the fixed contact F2, then the operation of finally closing the electric circuit is performed at one pair of moving and fixed contacts that come into contact with each other later than the other pair of moving and fixed contacts. Thus, the arc generated when the electric circuit is closed may place a heavier load on the pair of moving and fixed contacts that comes into contact with each other later rather than on the pair of moving and fixed contacts that comes into contact with each other earlier. Shortening the time lag between the timing when the moving contact M1 comes into contact with the fixed contact F1 and the timing when the moving contact M2 comes into contact with the fixed contact F2 by performing the time lag adjustment described above reduces the chances of imposing a concentrated load on one moving contact and one fixed contact. This curbs a decline in the performance of contact between a pair of moving contacts M1, M2 and a pair of fixed contacts F1, F2.

Detecting the degree of synchronism between the respective pairs of contacts and adjusting the time lag between the timing when the moving contact M1 comes into contact with the fixed contact F1 and the timing when the moving contact M2 comes into contact with the fixed contact F2 during the manufacturing process of the electromagnetic relay 1 allows an electromagnetic relay 1 with a shortened time lag to be manufactured.

Optionally, in this electromagnetic relay 1, the probe 10 and the armature 3 may be displaced by passing the probe 10 through the through hole 841 of the overlay 8 and applying a predetermined load to the probe 10 to make the probe 10 press the armature 3 under the control of the controller 14. This allows the controller 14 to measure the relation between the magnitude of displacement of the probe 10 (i.e., the magnitude of displacement of the armature 3) and the load applied onto the probe 10. This measurement is suitably made before the step of detecting the degree of synchronism between the respective pairs of contacts. If necessary, the spring load of the movable spring 7 may be adjusted (changed) based on the result of measurement of the relation between the magnitude of displacement of the armature 3 and the load applied to the probe 10. Note that when the relation between the magnitude of displacement of the armature 3 and the load applied to the probe 10 is measured, the armature 3 may be displaced by having a member with no electrical conductivity, instead of the probe 10 with electrical conductivity, press the armature 3.

The processor 13, the controller 14, and the agent that carries out the method for detecting the degree of synchronism between respective pairs of contacts according to the present disclosure each include a computer system. The computer system includes one or more computers. In that case, the computer system may include, as principal hardware components, a processor and a memory. The functions of the processor 13, the controller 14, and the agent that carries out the method for detecting the degree of synchronism between respective pairs of contacts according to the present disclosure may be performed by making the processor execute a program stored in the memory of the computer system. The program may be stored in advance in the memory of the computer system. Alternatively, the program may also be downloaded through a telecommunications line or be distributed after having been recorded in some non-transitory storage medium such as a memory card, an optical disc, or a hard disk drive (magnetic disk), any of which is readable for the computer system. The processor of the computer system may be made up of one or more electronic circuits including a semiconductor integrated circuit (IC) or a largescale integrated circuit (LSI). Those electronic circuits may be either integrated together on a single chip or distributed on multiple chips, whichever is appropriate. Those multiple chips may be integrated together in a single device or distributed in multiple devices without limitation.

(Advantages)

In a known electromagnetic relay including a pair of fixed contacts and a pair of moving contacts, a time lag may be caused between a timing when one moving contact comes into contact with one fixed contact and a timing when the other moving contact comes into contact with the other fixed contact. Thus, there is an increasing demand for development of an electromagnetic relay with a configuration for determining whether or not there is such a time lag. It is therefore an object of the present disclosure to provide an electromagnetic relay with such a configuration for determining whether or not there is either a time lag between the timing when one moving contact comes into contact with one fixed contact and the timing when the other moving contact comes into contact with the other fixed contact or a time lag between the timing when one moving contact goes out of contact with one fixed contact and the timing when the other moving contact goes out of contact with the other fixed contact.

In the embodiment described above, the space inside the opening 842 that exposes the exposed part 94 crosses the plane P1 that intersects at right angles with the first direction D1. The plane P1 passes through the center C1 between both ends (ends T1, T2) in the first direction of the adhering portion AD1 (see FIGS. 5 and 6). Thus, the probe's 10 pressing, at the exposed part 94, the moving contactor 9 allows the force in the third direction D3 to be applied to the moving contactor 9 toward a region, adjacent in the second direction D2 to the center C1, of the adhering portion AD1. On the other hand, when the excitation coil 21 is energized (i.e., when the electromagnet E1 is excited) to attract the armature 3 toward the electromagnet E1, the force in the third direction D3 is applied to the armature 3, thus displacing the moving contactor 9 in the third direction D3. This allows the displacement of the moving contactor 9 when the probe 10 presses, at the exposed part 94, the moving contactor 9 to appear quite similar to the displacement of the moving contactor 9 when the excitation coil 21 is energized. This allows the processor 13 to more accurately detect the time lag between the timing when the moving contact M1 comes into contact with the fixed contact F1 and the timing when the moving contact M2 comes into contact with the fixed contact F2 than in a situation where the space inside the opening 842 does not cross the plane P1.

Also, when the armature 3 is adhered onto the iron core 23, the exposed part 94 overlaps in the third direction D3 with the iron core 23 with the overlay 8 and the armature 3 interposed between the exposed part 94 itself and the iron core 23. This increases the chances of the displacement of the moving contactor 9 when the moving contactor 9 is pressed with the probe 10 pressed against the exposed part 94 appearing quite similar to the displacement of the moving contactor 9 when the excitation coil 21 is energized. This allows the processor 13 to more accurately detect the time lag between the timing when the moving contact M1 comes into contact with the fixed contact F1 and the timing when the moving contact M2 comes into contact with the fixed contact F2.

Variations of First Embodiment

Next, variations of the first embodiment will be enumerated one after another. Optionally, the variations to be described below may be adopted in combination as appropriate.

In the electromagnetic relay 1 according to the first embodiment, the moving contact M1 is fixed onto the displaceable spring 91 and the moving contact M2 is fixed onto the displaceable spring 92. However, this is only an example and should not be construed as limiting. Alternatively, the displaceable spring 91 and the moving contact M1 may be formed integrally. The displaceable spring 92 and the moving contact M2 may also be formed integrally.

In the electromagnetic relay 1 according to the first embodiment, the fixed contact F1 is fixed onto the primary terminal 271 and the fixed contact F2 is fixed onto the primary terminal 272. However, this is only an example and should not be construed as limiting. Alternatively, the primary terminal 271 and the fixed contact F1 may be formed integrally. The primary terminal 272 and the fixed contact F2 may also be formed integrally.

In the first embodiment described above, the overlay 8 is formed integrally with the movable spring 7 and the displaceable portion 90, and the movable spring 7 and the displaceable portion 90 are both partially embedded in the overlay 8. Alternatively, after the overlay 8, the movable spring 7, and the displaceable portion 90 have been formed separately from each other, the movable spring 7 and the displaceable portion 90 may be fitted into a depression provided for the overlay 8

Optionally, when the pair of moving contacts M1, M2 is out of contact with the pair of fixed contacts F1, F2, the stopper 53 may be in contact with the moving contactor 9, instead of the armature 3. For example, the moving contactor 9 may have a projection extended from the joint portion 93 and may be configured such that the projection comes into contact with the stopper 53. Alternatively, the electromagnetic relay 1 may also be configured such that the stopper 53 comes into contact with both the armature 3 and the moving contactor 9.

Also, any appropriate member with electrical conductivity may also be used instead of the probe 10 to detect the degree of synchronism between the respective pairs of contacts.

Furthermore, the plane P1 is a plane that intersects at right angles with the arrangement direction (i.e., the first direction D1). As used herein, when the plane P1 "intersects at right angles with" the arrangement direction, the arrangement direction and the plane P1 may naturally intersect with each other at exactly 90 degrees but may also intersect with each other at substantially 90 degrees. For example, the arrangement direction and the plane P1 may intersect with each other at an angle falling within the range from 85 degrees to 95 degrees.

Optionally, the armature 3 may have a plurality of adhering portions AD1 where the armature 3 is adhered onto the electromagnet E1. When a plurality of adhering portions AD1 is provided, both ends in the arrangement direction (i.e., the first direction D1) of the adhering portions AD1 refer to two outermost points, located opposite from each other in the arrangement direction (i.e., the first direction D1), of the plurality of adhering portions AD1.

Furthermore, the movable spring 7 does not have to be fixed onto the armature 3. Alternatively, the movable spring 7 may also be elastically deformed with the force received either directly or indirectly from the armature 3 when the armature 3 is displaced.

In the first embodiment described above, the exposed part 94 of the displaceable portion 90 is pressed by the probe 10 through the opening 842, thereby bringing corresponding pairs of moving and fixed contacts into contact with each other. However, this is only an example and should not be construed as limiting. Alternatively, the electromagnetic relay 1 may also be configured such that pressing the exposed part 94 with the probe 10 through the opening 842 brings the corresponding pairs of moving and fixed contacts out of contact with each other. For example, in the first embodiment described above, the pair of fixed contacts F1, F2 is arranged closer to the electromagnet E1 when viewed from the pair of moving contacts M1, M2. Alternatively, the pair of fixed contacts F1, F2 may be arranged opposite from the electromagnet E1 when viewed from the pair of moving contacts M1, M2. Furthermore, the respective members may also be arrangement such that when the excitation coil 21 is not energized, the corresponding pairs of moving and fixed contacts come into contact with each other. In that case, pressing the exposed part 94 with the probe 10 through the opening 842 when the excitation coil 21 is not energized may cause the pair of moving contacts M1, M2 to be displaced toward the electromagnet E1 to bring the corresponding pairs of moving and fixed contacts out of contact with each other. Also, in that case, the corresponding pairs of fixed and moving contacts may also be brought out of contact with each other by energizing the excitation coil 21 as well. Then, it may be determined, by the same method as the method for detecting the degree of synchronism between the respective contacts as described for the first embodiment, whether or not the timing when the moving contact M1 goes out of contact with the fixed contact F1 agrees with the timing when the moving contact M2 goes out of contact with the fixed contact F2 or how long the time lag between the two timings is if the answer is NO.

Moreover, the processor 13 just needs to determine whether or not there is any time lag between the timing when the moving contact M1 comes into contact with the fixed contact F1 and the timing when the moving contact M2 comes into contact with the fixed contact F2 or whether or not there is any time lag between the timing when the moving contact M1 goes out of contact with the fixed contact F1 and the timing when the moving contact M2 goes out of contact with the fixed contact F2. The processor 13 does not have to detect the length of the time lag.

Furthermore, the armature 3 may also be configured to directly actuate the moving contactor 9 instead of indirectly actuating the moving contactor 9 by applying force to the movable spring 7. For example, the armature 3 may also be configured to actuate the moving contactor 9 by being directly fixed onto the moving contactor 9 and being displaced along with the moving contactor 9.

Furthermore, in the first embodiment described above, the electromagnetic relay 1 is implemented as a hinged relay just by way of example. However, the electromagnetic relay 1 does not have to be implemented as hinged relay but may also be implemented as a plunger type relay in which the moving and fixed contacts come into, and go out of, contact with each other by linearly moving a plunger provided with an armature.

Optionally, a processing unit performing the function of the processor 13 and a control unit performing the function of the controller 14 may be integrated together in the same device.

Furthermore, the respective constituent elements of the electromagnetic relay 1 do not have to have the shapes described for the first embodiment. For example, a constituent element formed in a rectangular shape according to the first embodiment may also be formed in a square shape. Also, a constituent element formed in a rectangular parallelepiped shape according to the first embodiment may also be formed in a cubic shape.

(Resume)

As can be seen from the foregoing description, an electromagnetic relay 1 according to a first aspect includes a pair of fixed contacts F1, F2, a moving contactor 9, an overlay 8, an electromagnet E1, and an armature 3. The moving contactor 9 includes a pair of moving contacts M1, M2 and a displaceable portion 90. The pair of moving contacts M1, M2 corresponds one to one to the pair of fixed contacts F1, F2. The displaceable portion 90 is connected to, and electrically conductive with, the pair of moving contacts M1, M2 and displaceable along with the pair of moving contacts M1, M2. The overlay 8 is arranged to overlap with the displaceable portion 90. The electromagnet E1 has an excitation coil 21. The armature 3 actuates the moving contactor 9 by being attracted toward the electromagnet E1 with electromagnetic force generated by the electromagnet E1 to bring each of the pair of moving contacts M1, M2 into, or out of, contact with a corresponding one of the pair of fixed contacts F1, F2. The armature 3 has an adhering portion AD1. The adhering portion AD1 is adhered onto the electromagnet E1 with the electromagnetic force generated by the electromagnet E1. The overlay 8 has an opening 842. The opening 842 exposes a part (exposed part 94) of the displaceable portion 90. A space inside the opening 842 crosses a predetermined plane (plane P1). The predetermined plane intersects at right angles with an arrangement direction (first direction D1) in which the pair of moving contacts M1, M2 is arranged side by side. The predetermined plane passes through a center C1 between both ends (ends T1, T2) in the arrangement direction of the adhering portion AD1.

This configuration allows the pair of moving contacts M1, M2 to be displaced along with the displaceable portion 90 by pushing the displaceable portion 90 with a probe 10 or any other instrument pressed against a part (exposed part 94), exposed through the opening 842, of the displaceable portion 90 while the excitation coil 21 is not energized, This allows each of the moving contacts to be brought into, or out of, contact with a corresponding one of the fixed contacts. In this case, while one moving contact and a fixed contact corresponding to the moving contact are out of contact, and electrically nonconductive, with each other, the probe 10 and the fixed contact are electrically nonconductive with each other, either. On the other hand, while one moving contact and a fixed contact corresponding to the moving contact are in contact, and electrically conductive, with each other, the probe 10 and the fixed contact are electrically conductive with each other as well. Thus, detecting a variation in the condition of electrical conduction between each moving contact and its corresponding fixed contact when the displaceable portion 90 is pushed with the probe 10 pressed against the exposed part 94 during the manufacturing process of the electromagnetic relay 1, for example, allows the degree of synchronism between the respective pairs of contacts to be detected. As used herein, "detecting the degree of synchronism between the respective pairs of contacts" refers to determining whether or not the timing when one moving contact comes into, or goes out of, contact with one fixed contact agrees with the timing when the other moving contact comes into, or goes out of, contact with the other fixed contact, or how long the time lag between the two timings is if the answer is NO. That is to say, this electromagnetic relay 1 has a configuration for determining, using the probe 10 or any other instrument, whether or not there is any time lag between the timing when one moving contact comes into contact with one fixed contact and the timing when the other moving contact comes into contact with the other fixed contact or whether or not there is any time lag between the timing when one moving contact goes out of contact with one fixed contact and the timing when the other moving contact goes out of contact with the other fixed contact.

In this configuration, a space inside the opening 842, which exposes a part (exposed part 94) of the displaceable portion 90, of the overlay 8 crosses a predetermined plane (plane P1) that intersects at right angles with an arrangement direction (first direction D1) in which the pair of moving contacts M1, M2 is arranged side by side. The predetermined plane passes through a center C1 between both ends (ends T1, T2) in the arrangement direction of the adhering portion AD1. This allows the displacement of the moving contactor 9 (including the displaceable portion 90 and the pair of moving contacts M1, M2) when the displaceable portion 90 is pushed with the probe 10 or any other instrument pressed against the exposed part 94 to appear quite similar to the displacement of the moving contactor 9 when the armature 3 and the moving contactor 9 are displaced with the electromagnetic force generated by the electromagnet E1 while the excitation coil 21 is energized. Thus, such a configuration of this electromagnetic relay 1 facilitates more accurately detecting the degree of synchronism between respective pairs of contacts, compared to a situation where the space inside the opening 842 does not cross the predetermined plane.

In an electromagnetic relay 1 according to a second aspect, which may be implemented in conjunction with the first aspect, a midpoint C23 between respective centers C2, C3 of the pair of moving contacts M1, M2 is located on the predetermined plane (plane P1).

According to this configuration, the distance from a part (exposed part 94), exposed through the opening 842, of the displaceable portion 90 to the center of one moving contact M1 is approximately equal to the distance from the part (exposed part 94), exposed through the opening 842, of the displaceable portion 90 to the center of the other moving contact M2. This facilitates, when the exposed part 94 is pushed, generally parallel movement of the pair of moving contacts M1, M2, thus reducing the chances of the relative positions of the moving contacts M1, M2 deviating from each other. Thus, such a configuration of this electromagnetic relay 1 facilitates more accurately detecting the degree of synchronism between respective pairs of contacts.

In an electromagnetic relay 1 according to a third aspect, which may be implemented in conjunction with the first or second aspect, in a direction in which the displaceable portion 90 and the electromagnet E1 are arranged (i.e., a direction aligned with the third direction D3), the opening 842 is located on an opposite side from the electromagnet E1 with respect to the displaceable portion 90.

This configuration allows the probe 10 or any other instrument to be pressed, from the opposite side from the electromagnet E1, against the part (exposed part 94), exposed through the opening 842, of the displaceable portion 90, thus more easily securing an arrangement space for the probe 10 or any other instrument.

An electromagnetic relay 1 according to a fourth aspect, which may be implemented in conjunction with any one of the first to third aspects, further includes a stopper 53. While the pair of moving contacts M1, M2 is out of contact with the pair of fixed contacts F1, F2, the stopper 53 keeps in contact with at least one of the moving contactor 9 or the armature 3 from an opposite side from the electromagnet E1 in a direction in which the adhering portion AD1 and the electromagnet E1 are arranged (i.e., in the direction aligned with the third direction D3). The stopper 53 crosses the predetermined plane (i.e., plane P1).

This configuration allows, while the pair of moving contacts M1, M2 is out of contact with the pair of fixed contacts F1, F2, the stopper 53 to reduce the chances of the pair of moving contacts M1, M2 going further away from the pair of fixed contacts F1, F2. In addition, unlike a situation where the stopper 53 does not cross the predetermined plane (plane P1), this makes the load placed on at least one of the moving contactor 9 or the armature 3 when at least one of the moving contactor 9 or the armature 3 comes into contact with the stopper 53 substantially uniform at respective sites in the arrangement direction (i.e., the first direction D1).

An electromagnetic relay 1 according to a fifth aspect, which may be implemented in conjunction with any one of the first to fourth aspects, further includes a movable spring 7. The movable spring 7 is fixed to the armature 3 and electrically insulated from the moving contactor 9. The movable spring 7 is fixed to the moving contactor 9 via the overlay 8 and displaces the moving contactor 9 by being deformed as the armature 3 is displaced.

This configuration allows, if the spring load of the movable spring 7 is adjustable during the manufacturing process of the electromagnetic relay 1, for example, the contact pressure between each moving contact and a corresponding fixed contact to be regulated.

In an electromagnetic relay 1 according to a sixth aspect, which may be implemented in conjunction with any one of the first to fifth aspects, the displaceable portion 90 includes a pair of displaceable springs 91, 92. The displaceable springs 91, 92 correspond one to one to the pair of moving contacts M1, M2. The pair of displaceable springs 91, 92 is connected to, and electrically conductive with, the pair of moving contacts M1, M2, respectively.

This configuration allows the distance from each moving contact to a corresponding fixed contact to be adjusted by changing the shape or any other parameter of the pair of displaceable springs 91, 92 through the process step of bending the pair of displaceable springs 91, 92 during the manufacturing process of the electromagnetic relay 1, for example. This reduces the time lag between the timing when one moving contact comes into (or goes out of) contact with one fixed contact and the timing when the other moving contact comes into (or goes out of) contact with the other fixed contact.

Second Embodiment

Figure 8:
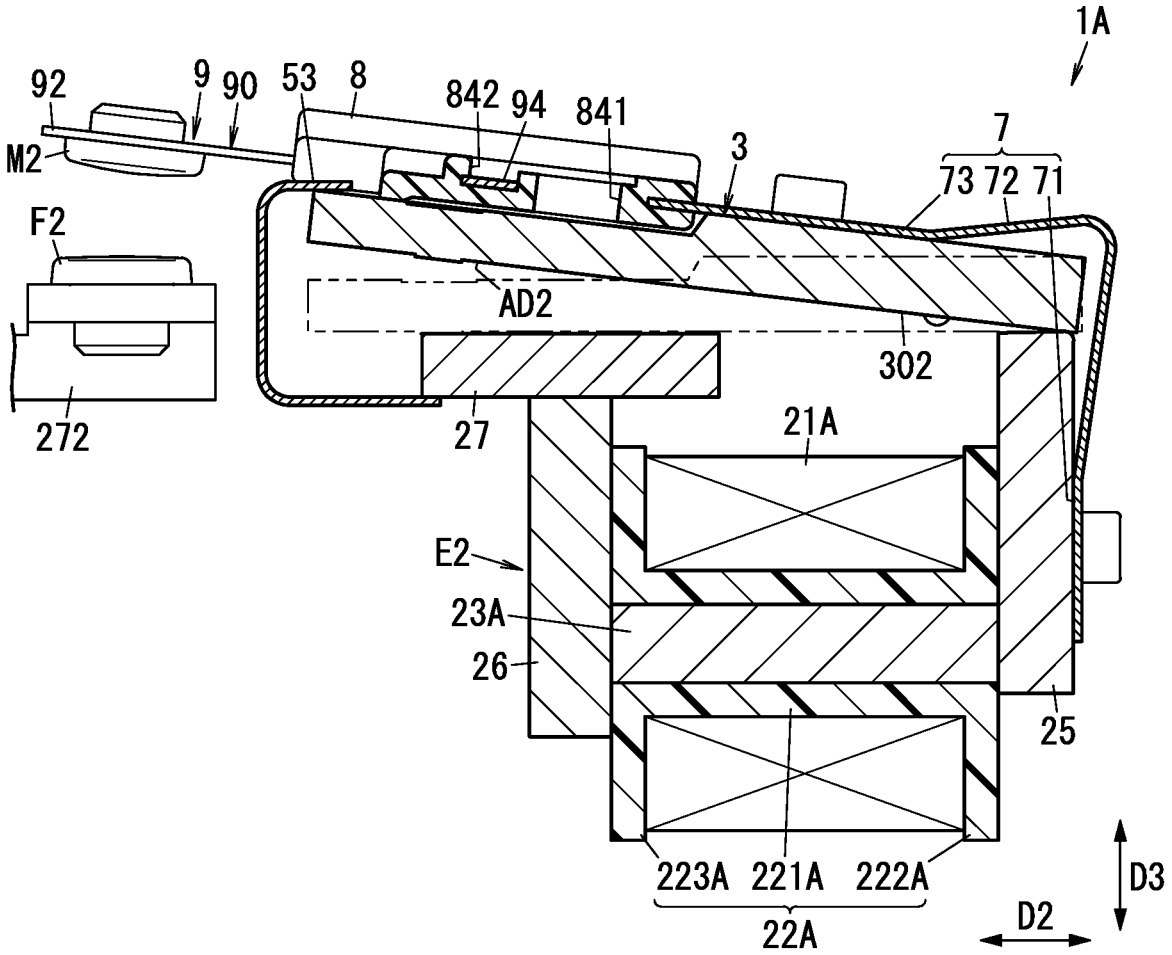
FIG. 8 is a cross-sectional view illustrating a main part of an electromagnetic relay according to a second embodiment.
Figure 9:
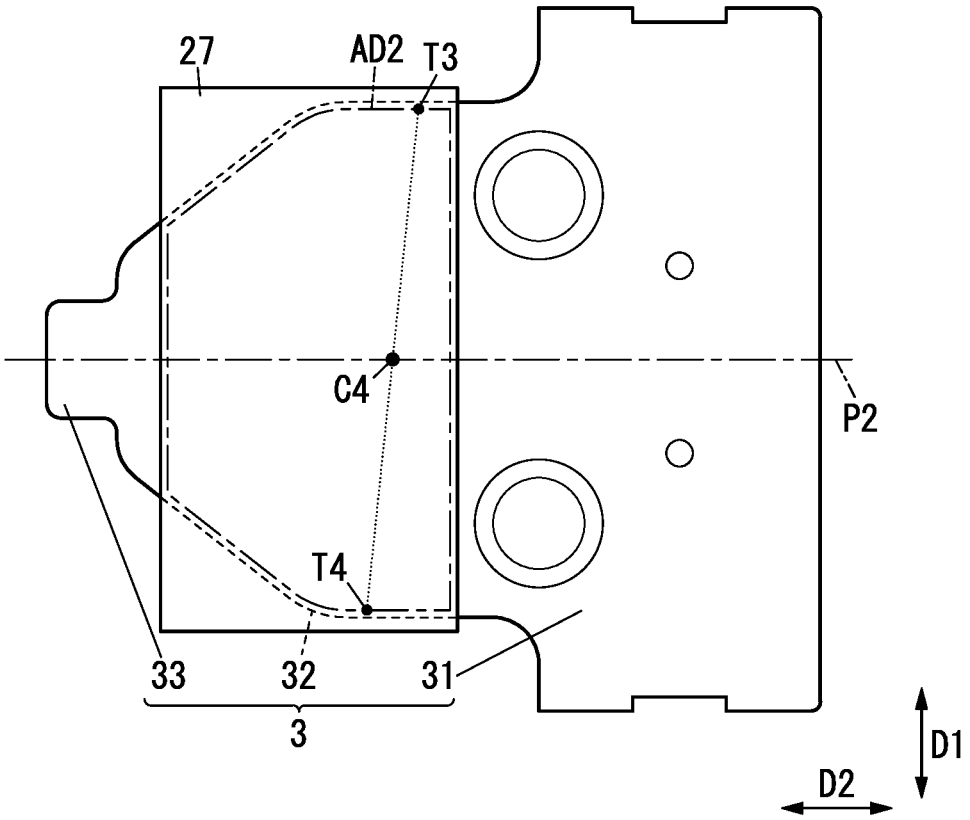
FIG. 9 is a bottom view illustrating an armature and a fifth yoke of the electromagnetic relay.

An electromagnetic relay 1A according to a second embodiment will be described with reference to FIGS. 8 and 9. FIGS. 8 and 9 are schematic representations illustrating a main part of the electromagnetic relay 1A. In the following description, any constituent element of this second embodiment, having the same function as a counterpart of the first embodiment described above, will be designated by the same reference numeral as that counterpart's, and description thereof will be omitted herein.

In the first embodiment described above, the axis of the excitation coil 21 and the bobbin 22 is aligned with the third direction D3. Meanwhile, in this second embodiment, the axis of an excitation coil 21A and a bobbin 22A is aligned with the second direction D2 perpendicular to the third direction D3. An iron core 23A is formed in the shape of a circular column, of which the axis is aligned with the second direction D2.

An electromagnet E2 includes the excitation coil 21A, the iron core 23A, a third yoke 25, a fourth yoke 26, and a fifth yoke 27.

The third yoke 25, the fourth yoke 26, and the fifth yoke 27 are each formed in the shape of a generally rectangular plate. The third yoke 25 is in contact with a first end in the second direction D2 of the iron core 23A and a rim 222A of the bobbin 22A. The third yoke 25 is magnetically coupled to the iron core 23A. The fourth yoke 26 is in contact with a second end in the second direction D2 of the iron core 23A and a rim 223A of the bobbin 22A. The fourth yoke 26 is also magnetically coupled to the iron core 23A. The third yoke 25 and the fourth yoke 26 are arranged in the third direction D3. The fifth yoke 27 is in contact with one end in the third direction D3 of the fourth yoke 26. The thickness of the fifth yoke 27 is aligned with the third direction D3. The length of the fifth yoke 27 is aligned with the first direction D1. The width of the fifth yoke 27 is aligned with the second direction D2. The fifth yoke 27 is magnetically coupled to the iron core 23A via the fourth yoke 26. The iron core 23A, the third yoke 25, the fourth yoke 26, and the fifth yoke 27 together form a magnetic path through which a magnetic flux passes when the excitation coil 21A is energized.

The third yoke 25 is in contact with one end, located closer to the fixing portion 71 of the movable spring 7, of the armature 3. The armature 3 is supported by the third yoke 25.

When the excitation coil 21A is not energized, the second surface 302 of the armature 3 faces the fifth yoke 27. When the excitation coil 21A is energized, the armature 3 is adhered, on the second surface 302 thereof, onto the fifth yoke 27 as indicated by the two-dot chain in FIG. 8. While the armature 3 is adhered onto the fifth yoke 27, the through hole 841 of the overlay 8 and the exposed part 94 of the displaceable portion 90 overlap in the third direction D3 with the fifth yoke 27.

FIG. 9 illustrates, out of the constituent elements of the electromagnetic relay 1A, only the armature 3 and the fifth yoke 27 and shows a state where the armature 3 is adhered onto the fifth yoke 27.

The armature 3 and the fifth yoke 27 are arranged in the third direction D3 one on top of the other. The armature 3 has an adhering portion AD2 to be adhered onto the fifth yoke 27 of the electromagnet E2. The adhering portion AD2 is a trapezoidal portion of the armature 3 that overlaps in the third direction D3 with the fifth yoke 27 when the adhering portion AD2 is adhered onto the fifth yoke 27. The adhering portion AD2 is located in the extended portion 32 of the armature 3. The adhering portion AD2 faces the fifth yoke 27. Both ends (ends T3 and T4) in the first direction D1 (arrangement direction) of the adhering portion AD2 are two outermost points, located opposite from each other in the first direction D1 (i.e., at the top and bottom of the paper on which FIG. 9 is drawn), of the adhering portion AD2.

A center C4 between the ends T3 and T4 is a point on a line that passes through the midpoint between the ends T3 and T4 and that extends in the second direction D2. This line is located on a plane P2 (predetermined plane) that intersects at right angles with the first direction D1 and that passes through the center C4. The plane P2 crosses the space inside the opening 842. The plane P2 also crosses the exposed part 94. Furthermore, the plane P2 further crosses the space inside the through hole 841. In addition, the plane P2 further crosses the stopper 53. The plane P2 is aligned with the second direction D2 and the third direction D3.

In the adhering portion AD2 shown in FIG. 9, not only the ends T3 and T4 but also respective points arranged in the second direction D2 with respect to the end T3 or T4 are points each corresponding to one of both ends in the first direction D1 of the adhering portion AD2. One end and the other end, out of both ends in the first direction D1, of the adhering portion AD2 may be defined from among these points. Even in that case, the location and orientation of a predetermined plane that intersects at right angles with the first direction D1 and that passes through the center between both ends in the first direction D1 of the adhering portion AD2 are the same as the location and orientation of the plane P2 according to this embodiment.

As described for this embodiment, the adhering portion of the armature 3 may be adhered onto the fifth yoke 27, which is a member different from the iron core 23A that passes through the inside of the excitation coil 21A. Alternatively, the adhering portion of the armature 3 may also be adhered onto another member magnetically coupled to the iron core 23A, instead of the fifth yoke 27.

Alternatively, as already described for the first embodiment, the adhering portion of the armature 3 may also be adhered onto the iron core 23 that passes through the inside of the excitation coil 21.

Optionally, in the electromagnet E2 according to the second embodiment, two or more members selected from the group consisting of the iron core 23A, the third yoke 25, the fourth yoke 26, and the fifth yoke 27 may be formed integrally with each other.

Various embodiments described above, as well as the variations thereof, may be adopted in combination as appropriate.

Note that the constituent elements according to the second to sixth aspects described in the "Resume" section are not essential constituent elements for the electromagnetic relay 1, 1A but may be omitted as appropriate.

REFERENCE SIGNS LIST

1, 1A Electromagnetic Relay
21, 21A Excitation Coil
3 Armature
53 Stopper
7 Movable Spring
8 Overlay
842 Opening
9 Moving Contactor
90 Displaceable Portion
91, 92 Displaceable Springs
94 Exposed Part (Part)
AD1, AD2 Adhering Portion
C1, C4 Center
C2, C3 Center
C23 Midpoint
D1 First Direction (Arrangement Direction)
E1, E2 Electromagnet
F1, F2 Fixed Contacts
M1, M2 Moving Contacts
P1, P2 Plane (Predetermined Plane)
T1, T2 Ends (Both Ends)
T3, T4 Ends (Both Ends)

The invention claimed is:

1. An electromagnetic relay comprising:

a pair of fixed contacts;

a moving contactor including a pair of moving contacts corresponding one to one to the pair of fixed contacts and a displaceable portion connected to, and electrically conductive with, the pair of moving contacts and displaceable along with the pair of moving contacts;

an overlay arranged to overlap with the displaceable portion;

an electromagnet having an excitation coil; and an armature configured to actuate the moving contactor by being attracted toward the electromagnet with electromagnetic force generated by the electromagnet to bring each of the pair of moving contacts into, or out of, contact with a corresponding one of the pair of fixed contacts, the armature having an adhering portion to be adhered onto the electromagnet with the electromagnetic force generated by the electromagnet, the overlay having an opening that exposes a part of the displaceable portion, a space inside the opening crossing a predetermined plane that intersects at right angles with an arrangement direction in which the pair of moving contacts is arranged side by side, the predetermined plane passing through a center between both ends in the arrangement direction of the adhering portion.

2. The electromagnetic relay of claim 1, wherein a midpoint between respective centers of the pair of moving contacts is located on the predetermined plane.

3. The electromagnetic relay of claim 1, wherein in a direction in which the displaceable portion and the electromagnet are arranged, the opening is located on an opposite side from the electromagnet with respect to the displaceable portion.

4. The electromagnetic relay of claim 1, further comprising a stopper configured to, while the pair of moving contacts is out of contact with the pair of fixed contacts, keep in contact with at least one of the moving contactor or the armature from an opposite side from the electromagnet in a direction in which the adhering portion and the electromagnet are arranged, wherein the stopper crosses the predetermined plane.

5. The electromagnetic relay of claim 1, further comprising a movable spring fixed to the armature and electrically insulated from the moving contactor, wherein the movable spring is fixed to the moving contactor via the overlay and configured to displace the moving contactor by being deformed as the armature is displaced.

6. The electromagnetic relay of claim 1, wherein the displaceable portion includes a pair of displaceable springs corresponding one to one to the pair of moving contacts, and the pair of displaceable springs is connected to, and electrically conductive with, the pair of moving contacts, respectively.

7. The electromagnetic relay of claim 2, wherein in a direction in which the displaceable portion and the electromagnet are arranged, the opening is located on an opposite side from the electromagnet with respect to the displaceable portion.

8. The electromagnetic relay of claim 2, further comprising a stopper configured to, while the pair of moving contacts is out of contact with the pair of fixed contacts, keep in contact with at least one of the moving contactor or the armature from an opposite side from the electromagnet in a direction in which the adhering portion and the electromagnet are arranged, wherein the stopper crosses the predetermined plane.

9. The electromagnetic relay of claim 3, further comprising a stopper configured to, while the pair of moving contacts is out of contact with the pair of fixed contacts, keep in contact with at least one of the moving contactor or the armature from an opposite side from the electromagnet in a direction in which the adhering portion and the electromagnet are arranged, wherein the stopper crosses the predetermined plane.

10. The electromagnetic relay of claim 2, further comprising a movable spring fixed to the armature and electrically insulated from the moving contactor, wherein the movable spring is fixed to the moving contactor via the overlay and configured to displace the moving contactor by being deformed as the armature is displaced.

11. The electromagnetic relay of claim 3, further comprising a movable spring fixed to the armature and electrically insulated from the moving contactor, wherein the movable spring is fixed to the moving contactor via the overlay and configured to displace the moving contactor by being deformed as the armature is displaced.

12. The electromagnetic relay of claim 4, further comprising a movable spring fixed to the armature and electrically insulated from the moving contactor, wherein the movable spring is fixed to the moving contactor via the overlay and configured to displace the moving contactor by being deformed as the armature is displaced.

13. The electromagnetic relay of claim 2, wherein the displaceable portion includes a pair of displaceable springs corresponding one to one to the pair of moving contacts, and the pair of displaceable springs is connected to, and electrically conductive with, the pair of moving contacts, respectively.

14. The electromagnetic relay of claim 3, wherein the displaceable portion includes a pair of displaceable springs corresponding one to one to the pair of moving contacts, and the pair of displaceable springs is connected to, and electrically conductive with, the pair of moving contacts, respectively.

15. The electromagnetic relay of claim 4, wherein the displaceable portion includes a pair of displaceable springs corresponding one to one to the pair of moving contacts, and the pair of displaceable springs is connected to, and electrically conductive with, the pair of moving contacts, respectively.

16. The electromagnetic relay of claim 5, wherein the displaceable portion includes a pair of displaceable springs corresponding one to one to the pair of moving contacts, and the pair of displaceable springs is connected to, and electrically conductive with, the pair of moving contacts, respectively.

* * * * *